US008480353B2

(12) United States Patent
Koyabu et al.

(10) Patent No.: US 8,480,353 B2
(45) Date of Patent: Jul. 9, 2013

(54) COOLING SYSTEM OF RING SEGMENT AND GAS TURBINE

(75) Inventors: Hidemichi Koyabu, Tokyo (JP); Satoshi Hada, Tokyo (JP); Junichiro Masada, Tokyo (JP); Keizo Tsukagoshi, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 395 days.

(21) Appl. No.: 12/913,397

(22) Filed: Oct. 27, 2010

(65) Prior Publication Data

US 2011/0182724 A1 Jul. 28, 2011

(30) Foreign Application Priority Data

Jan. 26, 2010 (JP) ..... P2010-014356

(51) Int. Cl.
*F04D 29/58* (2006.01)

(52) U.S. Cl.
USPC ..... 415/116; 416/96 R; 415/173.1

(58) Field of Classification Search
USPC ..... 415/115, 116, 173.1; 416/96 R, 97 R
See application file for complete search history.

(56) References Cited

U.S. PATENT DOCUMENTS

| | | | | |
|---|---|---|---|---|
| 5,584,651 | A | 12/1996 | Pietraszkiewicz et al. | |
| 7,033,138 | B2 * | 4/2006 | Tomita et al. | 415/139 |
| 2004/0120803 | A1 | 6/2004 | Lucas et al. | |
| 2006/0182622 | A1 * | 8/2006 | Parker et al. | 415/116 |
| 2007/0020088 | A1 | 1/2007 | Durocher et al. | |
| 2007/0041827 | A1 | 2/2007 | Camus | |
| 2008/0118346 | A1 * | 5/2008 | Liang | 415/115 |

FOREIGN PATENT DOCUMENTS

| | | | |
|---|---|---|---|
| CN | 1527922 | A | 9/2004 |
| EP | 1022437 | A1 | 7/2000 |
| JP | 11-022411 | A | 1/1999 |
| JP | 2000-257447 | A | 9/2000 |
| JP | 2004-100682 | A | 4/2004 |
| JP | 2006-189044 | A | 7/2006 |
| JP | 2007-516375 | A | 6/2007 |
| JP | 2009-501860 | A | 1/2009 |
| WO | 2004/057159 | A1 | 7/2004 |

OTHER PUBLICATIONS

International Search Report of PCT/JP2010/069054, date of mailing Feb. 1, 2011.
Written Opinion of the International Searching Authority issued in International Application No. PCT/JP2010/069054.
Search Report mailed Mar. 27, 2013 in related Chinese Patent Application 201080031732.7. Partial Translation (Search Report).

* cited by examiner

*Primary Examiner* — Edward Look
*Assistant Examiner* — William Grigos
(74) *Attorney, Agent, or Firm* — Westerman, Hattori, Daniels & Adrian, LLP

(57) ABSTRACT

A cooling system of a ring segment for a gas turbine, which includes first cooling passages disposed in an axial direction of the rotating shaft of a main body of the segment body, second cooling passages disposed at one end portion in a direction approximately perpendicular to the first cooling passages, and blowing a cooling air toward the end portion of a neighboring segment body, and third cooling passages connecting a first cavity, which is disposed approximately perpendicular to the axial direction of the rotating shaft at the upstream-end portion, with a cooling space, which is surrounded by the segment body and a collision plate having a plurality of small holes. The first cooling passages include cooling passages of a first region and a second region having a smaller passage cross-sectional area than the first-region cooling passages or a greater arrangement pitch than the first-region cooling passages.

12 Claims, 7 Drawing Sheets

COOLING SYSTEM OF RING SEGMENT AND GAS TURBINE

FIELD OF THE INVENTION

The present invention relates to a cooling system of a ring segment applied to a gas turbine and the gas turbine.

Priority is claimed on Japanese Patent Application No 2010-014356, filed on Jan. 26, 2010, the contents of which are incorporated herein by reference.

BACKGROUND ART

Conventionally, since a high temperature, high pressure combustion gas passes through a turbine of a gas turbine, which is used in the generation of electrical energy, etc., it is important to cool a ring segment and the like in order to continue stabilized operation. In particular, due to improvements in the thermal efficiency of gas turbines in recent years, the temperature of combustion gas continues to increase, and it is necessary to further strengthen cooling capacity.

FIG. 6 is an overall configuration diagram of a gas turbine. A gas turbine 1 is made up of a compressor 2 compressing air for combustion, a combustor 3 injecting a fuel FL into the compressed air sent from the compressor 2 and combusting the injected fuel FL to generate combustion gas, a turbine 4 installed downstream of a flow direction of the combustion gas of the combustor 3 and driven by a combustion gas FG leaving the combustor 3, a generator 6, and a rotating shaft 5 integrally coupling the compressor 2, the turbine 4, and the generator 6.

FIG. 7 is a cross-sectional view showing an internal structure of the turbine 4 of the gas turbine 1.

The gas turbine 1 supplies the combustion gas FG generated in the combustor 3 to turbine vanes 7 and turbine blades 8, and causes the turbine blades 8 to rotate around the rotating shaft 5, thereby converting rotational energy into electrical power. The turbine vanes 7 and the turbine blades 8 are alternately disposed along the flow direction of the combustion gas FG. Moreover, the turbine blades 8 are disposed in a circumferential direction of the rotating shaft 5, and thus rotate together with the rotating shaft 5.

FIG. 8 is a cross-sectional view of essential portions of a conventional ring segment. A ring segment 40 is made up of a plurality of segment bodies 41, and is formed around the rotating shaft 5 in an annular shape. Each segment body 41 is supported by a casing 47 via hooks 42 and isolation rings 46. Moreover, a collision plate 44 that is supported by the isolation rings 46 is provided with a plurality of small holes 45. Cooling air CA supplied to the casing blows from the small holes 45 in a downward direction, thereby performing impingement cooling on a surface of a main body (bottom surface) of the segment body 41. In the segment body 41, a plurality of cooling passages 57 and 58 is formed in an axial direction of the rotating shaft 5 toward upstream- and downstream end faces of the flow direction of the combustion gas FG. The cooling air CA after the impingement cooling flows from the interior of the main body of the segment body 41 to the upstream and downstream sides of the axial direction of the rotating shaft 5 via the cooling passages 57 and 58, and then performs convection cooling on upstream- and downstream-end portions of the segment body 41. Moreover, the ring segment 40 is disposed on the outer circumferences of the turbine blades 8, and a fixed clearance is formed between the ring segment 40 and the tip of each turbine blade 8 so as to avoid mutual interference.

As shown in FIG. 9, the segment bodies 41 adjacent to each other are disposed such that end portions 51 and 52 thereof are opposite to each other. Moreover, the turbine blades 8 rotate around the rotating shaft 5 in a right-to-left direction on the sheet surface of FIG. 9 (a rotation direction R). Furthermore, to prevent the combustion gas FG from leaking from a gap between the end portions 51 and 52 to the casing, a seal plate 53 is inserted into the end portions 51 and 52 in the axial direction of the rotating shalt 5.

For this reason, the high-temperature combustion gas ingested by the rotation of the turbine blades 8 stays on the inner circumference of the seal plate 53. Thereby, an outer surface temperature of the segment bodies 41 is raised, and thus oxidation thinning easily takes place at a corner portion of each segment body 41. To avoid this phenomenon, cooling passages 55 and 56 are disposed on opposite sides of the end portions 51 and 52 of the neighboring segment bodies 41 such that the cooling air CA collides with the end portions 51 and 52 opposite each other.

That is, the cooling passage 55 is disposed in the end portion 51 which is front side in the rotation direction of the rotating shaft 5, and thus the cooling air CA, which has performed the impingement cooling on the main body of the segment body, is supplied to blow into the combustion gas of the gap G between the end portions 51 and 52 via a cavity 54. On the other band, the cooling passage 56 is also disposed in the end portion 52 which is rear side in the rotation direction of the neighboring segment body 41, and thus the cooling air CA after the impingement cooling blows into the gap between the end portions 51 and 52. The cooling passages 55 and 56 of both of the end portions 51 and 52 are disposed for blowing toward the corner portions of the lower sides of the end portions 51 and 52 of the segment bodies 41 adjacent to each other. By combination of the cooling passage 55 of the front-end portion 51 and the cooling passage 56 of the rear-end portion 52, each of the end portions 51 and 52 undergoes convection cooling, and a stagnant gas in the gap between the end portions 51 and 52 is purged into the combustion gas FC; and cools an atmospheric gas to prevent oxidation and thinning of the corner portions of the end portions 51 and 52 of the segment bodies 41.

An example of the cooling system of the ring segment described above is disclosed in Patent Document 1.

RELATED ART DOCUMENT

Patent Document

[Patent Document 1] Japanese Unexamined Patent Application Publication No. 2004-100682

DISCLOSURE OF THE INVENTION

Problems to be Solved by the Invention

However, according to the aforementioned cooling system of the gap G between the segment bodies 41, the atmospheric gas, which stagnates in the gap G between the end portions 51 and 52 of the segment bodies 41, is cooled to be able to prevent the oxidation and thinning of the corner portion of the segment body 41. However, there is a problem that an amount of the cooling air for purging increases, reducing the that efficiency in gas turbines.

The present invention has been made in view of the above-described circumstances, and an object of the invention is to provide a cooling system of a ring segment and a gas turbine, which prevent the oxidation and thinning of the segment body 41, promote reduction in the amount of cooling air for cooling the end portions 51 and 52 of the segment bodies 41, and increase thermal efficiency of the entire gas turbine.

Means for Solving the Problems

The present invention employs the following means to solve the aforementioned problems.

The present invention provides a cooling system of a ring segment for a gas turbine, which is formed of a plurality of segment bodies disposed around a rotating shaft in an annular shape, and a seal plate for sealing a gap between end portions facing each other in a direction of the rotating shaft of the segment bodies adjacent to each other, wherein the segment body includes: first cooling passages formed of cooling passages of a first region and cooling passages of a second region, the first-region cooling passages being disposed in an axial direction of the rotating shaft of a main body of the segment body and disposed adjacent to the end portion on a rear side in a rotation direction, and the second-region cooling passages being disposed on a farther front side in the rotation direction than the first-region cooling passages and having a smaller passage cross-sectional area than the first-region cooling passages; second cooling passages disposed at one of the end portions in a direction approximately perpendicular to the first cooling passages, and blowing a cooling air toward the end portion of the neighboring segment body; and third cooling passages disposed in the axial direction of the rotating shaft on a farther outer side in a radial direction than the first cooling passages of an upstream-end portion of the segment body, and connecting a first cavity, which is disposed approximately perpendicular to the axial direction of the rotating shaft at the upstream-end portion, with a cooling space, which is surrounded by the main body of the segment body and a collision plate having a plurality of small holes. Here, the first-region cooling passages are disposed adjacent to the second cooling passages of the neighboring segment body.

According to the present invention, since the cross-sectional area of each first-region cooling passage is greater than that of each second-region cooling passage, the cooling performance of the first-region cooling passages is increased, so that the cooling of the end portion on the rear side in the rotation direction is strengthened, and the cooling air blowing from the rear-end portion into the combustion gas of the gap portion can be omitted. Moreover, since the first-region cooling passages are diposed adjacent to the end portion to carry out convection cooling on the end portion, film cooling is reinforced by the cooling air blowing from the end portion of the neighboring segment body, and thus the cooling performance of the vicinity of the corner portion of the end portion is further strengthened. Further, the third cooling passages are provided on the outside in a radial direction of the upstream-end portion of the segment body, and thus the cooling of the segment body is further strengthened. As such, the segment body, particularly the corner portion of the end portion, is prevented from being oxidized and thinned. Simultaneously, the amount of cooling air for the entire segment body is reduced, and the thermal efficiency of the gas turbine is improved.

The present invention also provides a cooling system of a ring segment for a gas turbine, which is formed of a plurality of segment bodies disposed around a rotating shaft in an annular shape, and a seal plate for sealing a gap between end portions facing each other in a direction of the rotating shaft of the segment bodies adjacent to each other, wherein the segment body includes: first cooling passages formed of cooling passages of a first region and cooling passages of a second region, the first-region cooling passages being disposed in an axial direction of the rotating shaft of a main body of the segment body and disposed adjacent to the end portion on a rear side in a rotation direction, and the second-region cooling passages being disposed on a farther front side in the rotation direction than the first-region cooling passages and having a greater arrangement pitch than the first-region cooling passages; second cooling passages disposed at one of the end portions in a direction approximately perpendicular to the first cooling passages, and blowing cooling air toward the end portion of the neighboring segment body; and third cooling passages formed on a farther outer side in a radial direction than the first cooling passages of an upstream-end portion of the segment body, and connecting a first cavity, which is disposed approximately perpendicular to the axial direction of the rotating shaft at the upstream-end portion, with a cooling space, which is surrounded by the main body of the segment body and a collision plate having a plurality of small holes. Here, the first-region cooling passages are disposed adjacent to the second cooling passages of the neighboring segment body.

According to the present invention, since the arrangement pitch of the first-region cooling passages is smaller than that of the second-region cooling passages, the cooling performance of the first-region cooling passages is increased, so that the cooling of the end portion on the rear side in the rotation direction is strengthened, and the cooling air blowing from the rear-end portion into the combustion gas of the gap portion may be omitted. Moreover, since the first-region cooling passages are disposed adjacent to the end portion to carry out convection cooling on the end portion, film cooling by the cooling air blowing from the end portion of the neighboring segment body is reinforced, and thus the cooling performance of the vicinity of the corner portion of the end portion is further strengthened. Further, the third cooling passages are provided on an upper side of the upstream-end portion of the segment body and thus the cooling of the segment body is further strengthened. As such, the segment body, particularly the corner portion of the end portion, is prevented from being oxidized and thinned. Simultaneously, the amount of cooling air for the entire segment body is reduced, and the thermal efficiency of the gas turbine is improved.

The second cooling passages of the present invention may be disposed at least at the end portion on the front side in the rotation direction of the rotating shaft.

In this case, the end portion on the front side in the rotation direction which is apt to be exposed to high temperature is cooled, so that the oxidation and thinning of the vicinity of the front-end portion can be prevented.

The second cooling passages of the present invention may have a slope for blowing toward a lower corner portion of the end portion of the neighboring segment body.

In this case, since the second cooling passages are sloped downwardly, the blown cooling air collides with the lower corner portion of the neighboring end portion, and the vicinity of the corner portion of the segment body undergoes the film cooling, so that the oxidation and thinning of the corner portion exposed to high temperature can be prevented.

In the present invention, the first and third cooling passages may have a structure of turning back in the axial direction of the rotating shaft via the first cavity, and the first cooling passages may be disposed to pass from the first cavity through the main body of the segment body in the axial direction of the rotating shaft and to open on a downstream-end face.

In this case, since the first and third cooling passages have the structure of turning back in the axial direction of the rotating shaft via the first cavity, and each third cooling passage passes through the main body of the segment body in the axial direction and is open on the downstream-end portion at an end thereof, long cooling passages are formed in the axial direction of the rotating shaft, so that the main body of the segment body is efficiently cooled, and the amount of cooling air can be further reduced.

The present invention may provide a gas turbine having the aforementioned cooling system of a ring segment.

In this case, since the amount of cooling air for the ring segment is reduced, and the air amount is made appropriate, the thermal efficiency of the entire gas turbine is improved.

Effects of the Invention

According to the present invention, it is possible to prevent the oxidation and thinning of an end portion of a main body of a segment body, and reduce the amount of cooling air for the end portion. Thereby, the amount of cooling air for the entire ring segment is reduced, and the thermal efficiency of the entire gas turbine is improved.

BEST MODE FOR CARRYING OUT THE INVENTION

Embodiments of a cooling system of a ring segment and a gas turbine relating to the present invention will be described below with reference to FIGS. 1 through 7.

First Embodiment

The first embodiment will be described below with reference to FIGS. 1 through 3 and FIGS. 5 through 7. A turbine has the same configuration as that described in FIGS. 6 and 7 of the Background Art section, and a detailed description thereof will be omitted. The common components are given the same names and symbols.

Figure 1:
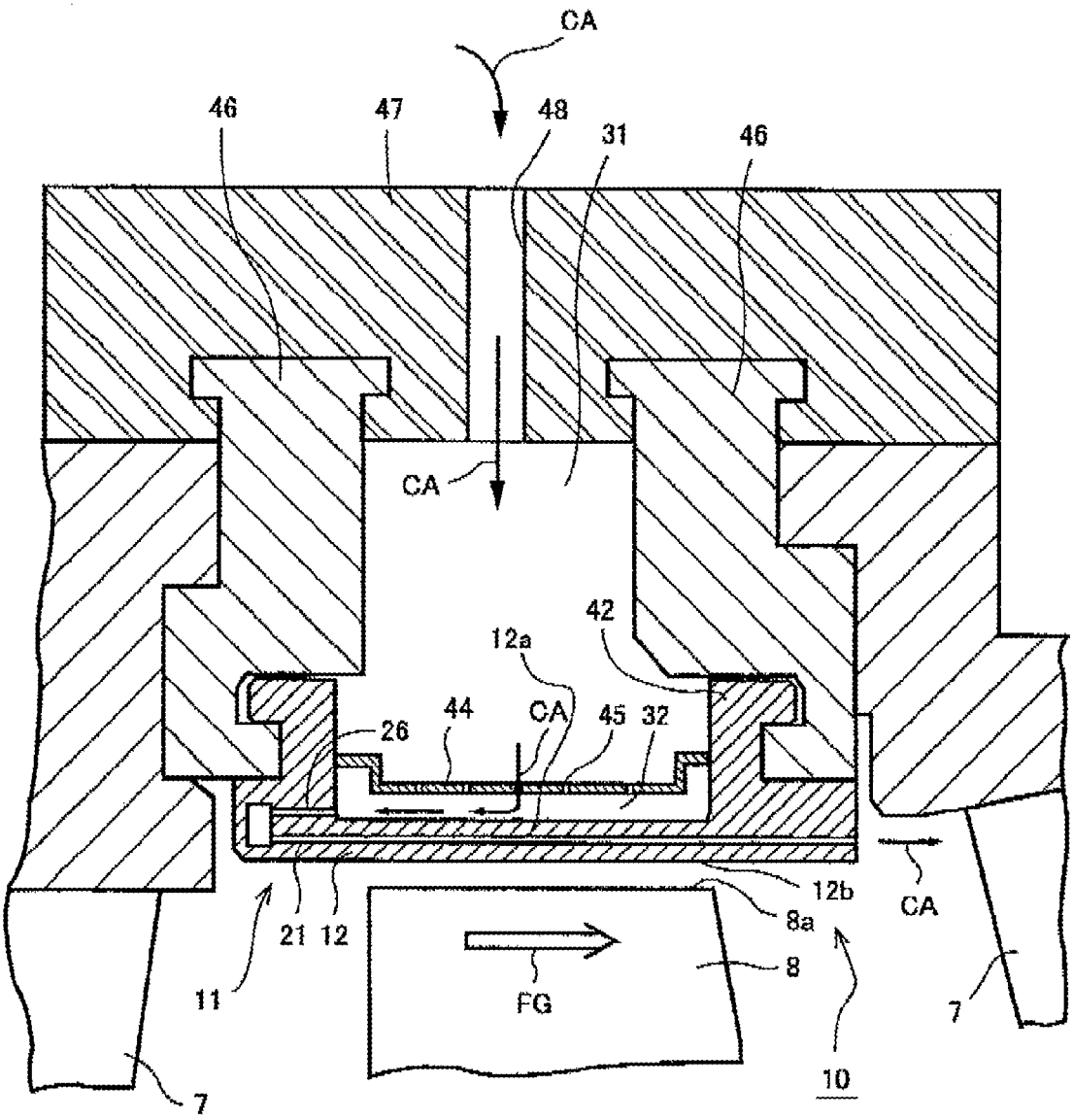
FIG. 1 is a cross-sectional view of essential portions of a ring segment according to a first embodiment.

FIG. 1 shows a cross section of essential portions of the ring segment of a gas turbine.

A ring segment 10 is a constituent member of a turbine 4 that is supported by a casing 47, and is made up of a plurality of segment bodies 11 that is arranged in the circumferential direction of a rotating shaft 5 to form a ring shape. As described in the Background Art section, the segment bodies 11 are disposed so that a fixed clearance is secured between the inner circumferential surface 12*b* of a main body (a bottom plate) 12 of each segment body 11 and a tip 8*a* of a turbine blade 8. The segment bodies 11 are formed, for example, of a heat-resistant nickel alloy or the like.

In the segment body 11, the main constituent elements are a main body (bottom plate) 12, hooks 42, and a collision plate 44. The segment body 11 is attached to isolation rings 46 via the hooks 42 that are disposed in upstream and downstream sides of the flow direction of combustion gas FG, and is supported in the casing 47 via the isolation rings 46. The segment body 11 is provided with a cooling space 32, which is enclosed by the main body 12, the collision plate 44, the hooks 42, and end portions 18 and 19 (see FIG. 2) provided on the front and rear sides in the direction that is approximately perpendicular to the axial direction of the rotating shaft 5 (hereinafter, referred to as a "cooling space"). The cooling space 32 is formed in the segment body 11, and is a space that is surrounded by outer circumferential surface 12*a* of the main body of the segment body 11.

The collision plate 44 partitions an upper space of the cooling space 32. The collision plate 44 is provided with a number of small holes 45 through which cooling air CA passes. A reception space 31 is disposed on the radial outer side of the collision plate 44, and the cooling air CA in the casing 47 is introduced into the reception space 31 via a supply hole 48. The cooling air CA supplied to the reception space 31 is blown from the small holes 45 into the cooling space 32 with the entirety equalized to approximately the same pressure, and performs impingement cooling on the outer circumferential surface 12*a* of the main body 12 of the segment body 11.

Figure 2:
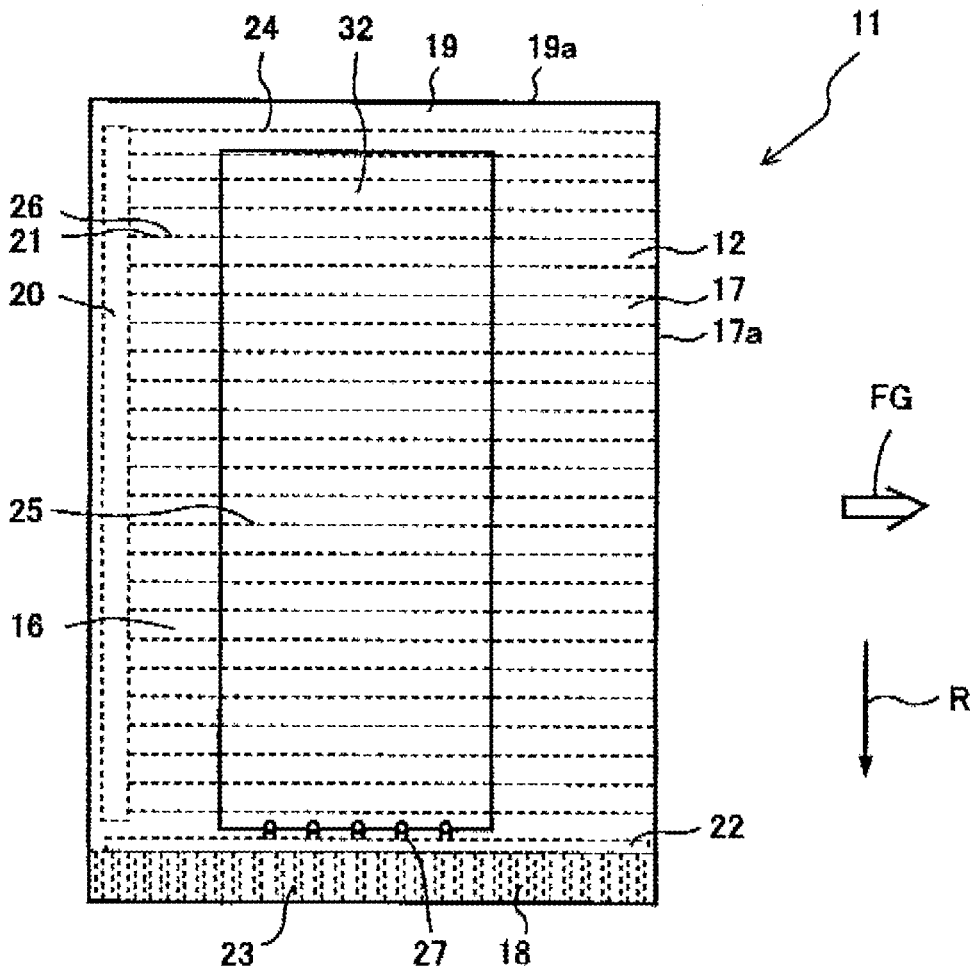
FIG. 2 is a top-down cross-sectional view of a segment body according to the first embodiment.

FIG. 2 is a top-down cross-sectional view of the segment body 11 when viewed from the radially outer side of the casing 47 in the rotating shaft direction. A cooling system of the main body of the segment body 11 will be described with reference to FIG. 2. The segment body 11 is provided with a first cavity 20, which is located at an upstream end portion 16 upstream of the flow direction of the combustion gas FG and is disposed approximately perpendicular to the axial direction of the rotating shaft 5. A plurality of main-body cooling passages (first cooling passages) 21 extends from the first cavity 20 to pass through the main body 12 of the segment body 11 in the axial direction of the rotating shaft 5, and open on a downstream-end face 17*a* downstream of the flow direction of the combustion gas FG.

Further, as shown in FIG. 1, the upstream-end portion 16 of the segment body 11 is provided with upstream end cooling passages (third cooling passages) 26, which connect the cooling space 32 and the first cavity 20, and communicate with the main-body cooling passages (first cooling passages) 21 via the first cavity 20. At the upstream-end portion 16, the upstream end cooling passages (third cooling passages) 26 are disposed on the radial outer side of the main body 12 of the segment body 11, whereas the main-body cooling passages (first cooling passages) 21 are disposed on radial inner sides of the upstream end cooling passages (third cooling passages) 26. Furthermore, the main-body cooling passages (first cooling passages) 21 and the upstream end cooling passages (third cooling passages) 26 are configured to turn back via the first cavity 20, and the cooling passages coupled in series in the axial direction of the rotating shaft 5 as a whole are formed. The main-body cooling passages (first cooling passages) 21 and the upstream end cooling passages (third cooling passages) 26 cause the cooling passages to be formed so as to have the maximum length in the axial direction of the rotating shaft 5. The first cavity 20 functions as a manifold that mutually couples the main-body cooling passages (first cooling passages) 21 and the upstream end cooling passages (third cooling passages) 26.

Figure 3:
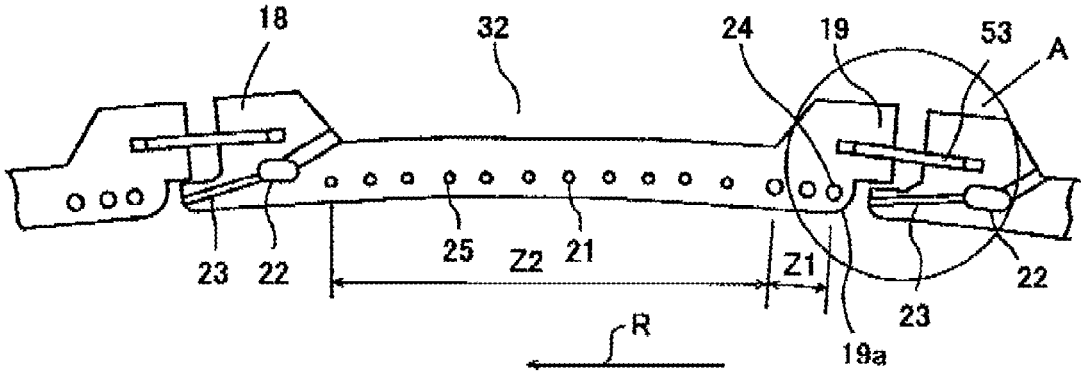
FIG. 3 is a cross-sectional view of the segment body according to the first embodiment.

FIG. 3 shows a cross section of the segment body 11 viewed from the rotating shaft 5. The main-body cooling passages (first cooling passages) 21 are formed as a plurality of multi-hole type cooling passages, which are formed of cooling passages 24 in a first region which have a large cross-sectional area and cooling passages 25 in a second region which have a smaller cross-sectional area than that of the first-region cooling passages 24. The main-body cooling passages (first cooling passages) 21 are arranged in the order of the second-region cooling passages 25 and the first-region cooling passages 24 from the end portion 18 on the front side in the rotation direction to the end portion 19 on the rear side. One or more of the cooling passages 24 may be provided in the first-region. A range of the cooling passages 24 arranged on the first region is indicated by a region Z1, whereas a range of the cooling passages 25 arranged on the second region is indicated by a region Z2.

The first-region cooling passages 24 are disposed adjacent to the end portion 19 on the rear side in the notation direction, particularly the corner portion 19*a* on a lower of the end portion 19, and are disposed parallel to the end portion 19. Like the second-region cooling passages 25, each of the first-region cooling passages 24 communicates with the first cavity 20 at one end thereof and opens to the combustion gas on the downstream-end face 17*a* at the other end thereof in the axial direction of the rotating shaft 5.

It is preferable that the main-body cooling passages (first cooling passages) 21 include circular passages and that they be disposed from the upstream side (an upstream end portion) of the flow direction of the combustion gas toward the downstream side (a downstream end portion) at the same arrangement pitch. Further, the passages may have an elliptical shape, a rectangular shape, or a slit shape, rather than the circular shape. The passages other than the first-region cooling passages 24 have the same opening cross-sectional area.

Next, a cooling system of the end portion of the segment body will be described below.

As shown in FIG. 2, the end portion 18 of the segment body 11 on the front side in the rotation direction R of the rotating shaft 5 is provided with end portion cooling passages (second cooling passages) 23, which are connected from the cooling space 32 to a second cavity 22 via junction passages 27 and communicate with the combustion gas FG from the second cavity 22. The end portion cooling passages (second cooling passages) 23 are disposed approximately perpendicular to the axial direction of the rotating shaft 5, but may be cooling passages (sloped passages) sloped to the axial direction of the rotating shaft 5.

Moreover, it is preferable that the end portion cooling passages (second cooling passages) 23 include circular passages and be disposed from the upstream side toward the downstream of the flow direction of the combustion gas FG with the same hole diameter at the same arrangement pitch. Moreover, the passages may have an elliptical shape, a rectangular shape, or a slit shape in addition to the circular shape.

Next, a cooling system of the portion of the gap of the segment body will be described using FIG. 5.

Figure 5:
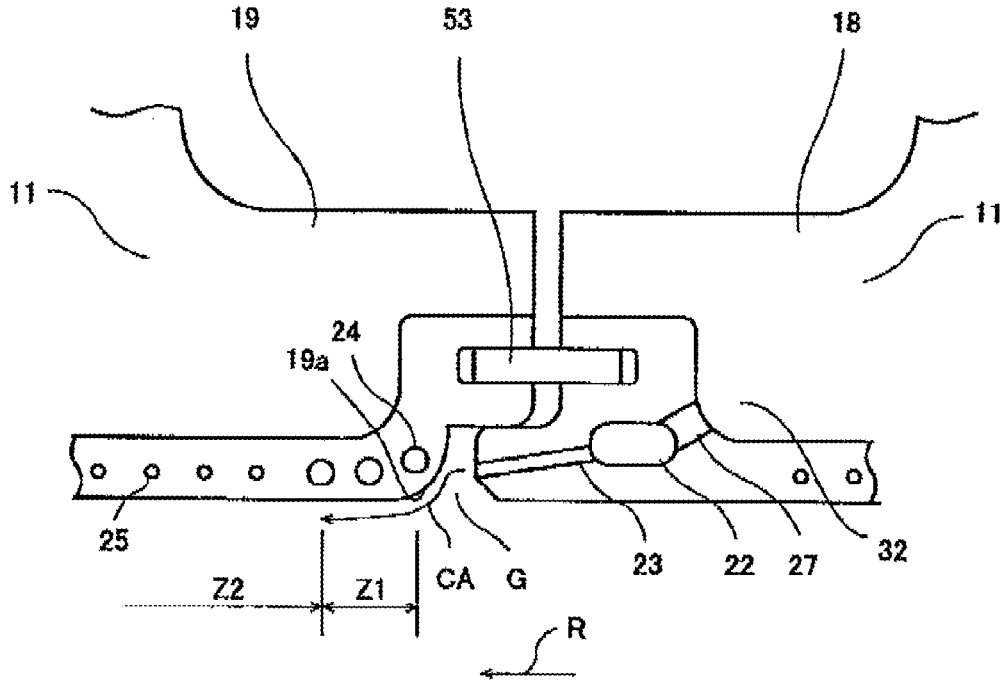
FIG. 5 is an enlarged cross-sectional view of the vicinity of an end portion of the segment body (a detailed view of part A of FIG. 3).
Figure 6:
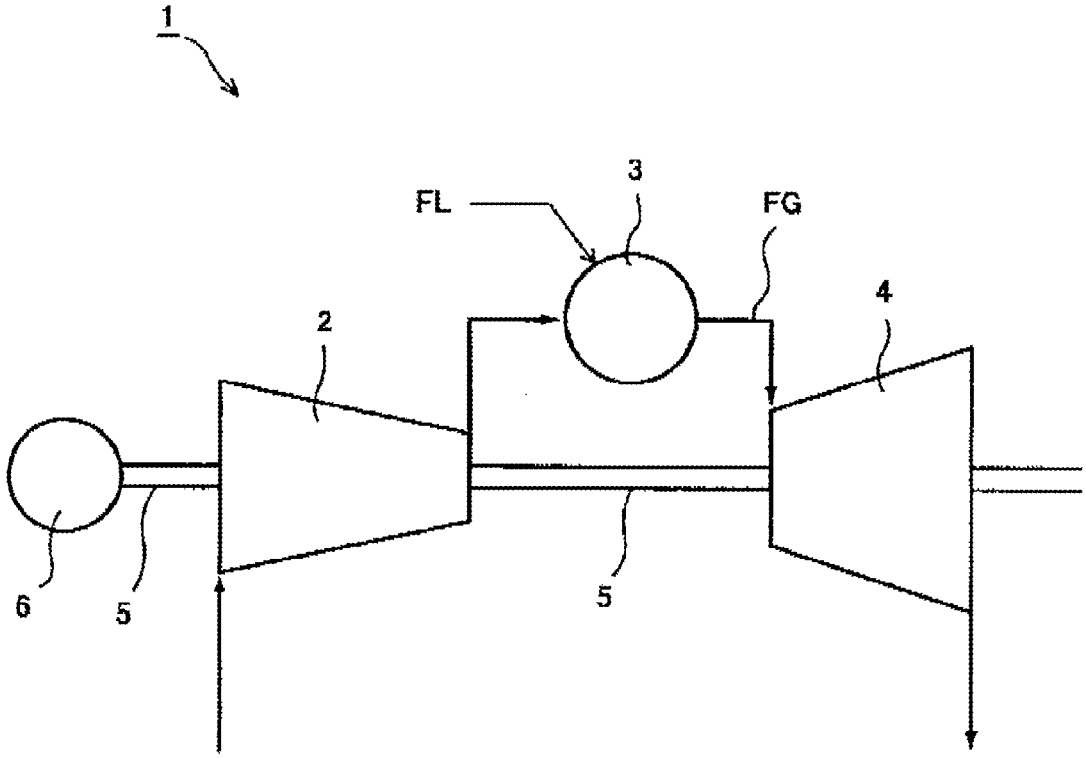
FIG. 6 shows an overall configuration of a gas turbine.
Figure 7:
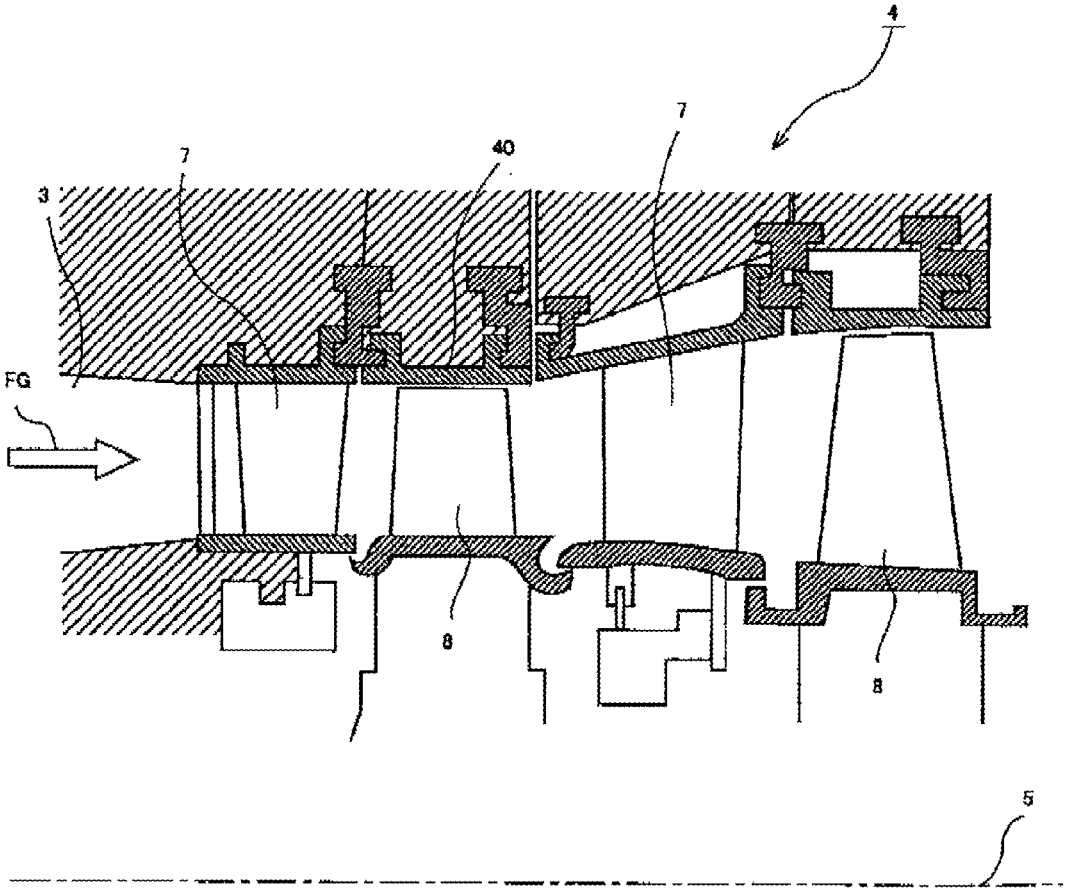
FIG. 7 shows an internal structure of a turbine.

FIG. 5 shows an enlarged cross section of the vicinity of the end portions of the neighboring segment bodies 11. The end portions 18 and 19 of the segment bodies 11 disposed so as to be opposite to each other have a seal plate 53 disposed in the axial direction of the rotating shaft 5 such that the combustion gas does not leak from the gap G formed between end portions 18 and 19 to the casing 47. Moreover, the end portion cooling passages (second cooling passages) 23 are disposed in the end portion 18 on the front side in the axial direction of the rotating shaft 5, and thus the cooling air CA after the impingement cooling is supplied from the cooling space 32 to the second cavity 22 via the junction passage 27, and blows into the combustion gas of the portion of the gap G between the end portions 18 and 19. The end portion cooling passages (second cooling passages) 23 are sloped downwardly to the front side in the rotation direction such that the blown cooling air CA collides with the corner portion 19*a* of the end portion 19 of the neighboring segment body 11. The cooling air CA blowing to the corner portion 19*a* of the end portion 19 flows from the vicinity of the corner portion 19*a* of the end portion along a lower surface of the segment body 11 in the direction indicated by the arrow of FIG. 5, and thus performs film cooling on the vicinity of the corner portion.

On the other hand, at the end portion 19 of the neighboring segment body 11 on the rear side in the rotation direction, the first-region cooling passages 24 are disposed adjacent to the corner portion 19*a* of the lower of the rear-end portion 19 without the cooling passages directly blowing to the portion of the gap G as shown in the aforementioned Patent Document 1. That is the surrounding outer surface of the corner portion 19*a* of the end portion 19 of the segment body on the rear side in the rotation direction is subjected to film cooling by the cooling air CA blowing from the end portion cooling passages (second cooling passage) 23 of the end portion 18 of the neighboring segment body 11, while the end portion 19 itself is subjected to convection cooling by the first-region cooling passages 24.

Figure 8:
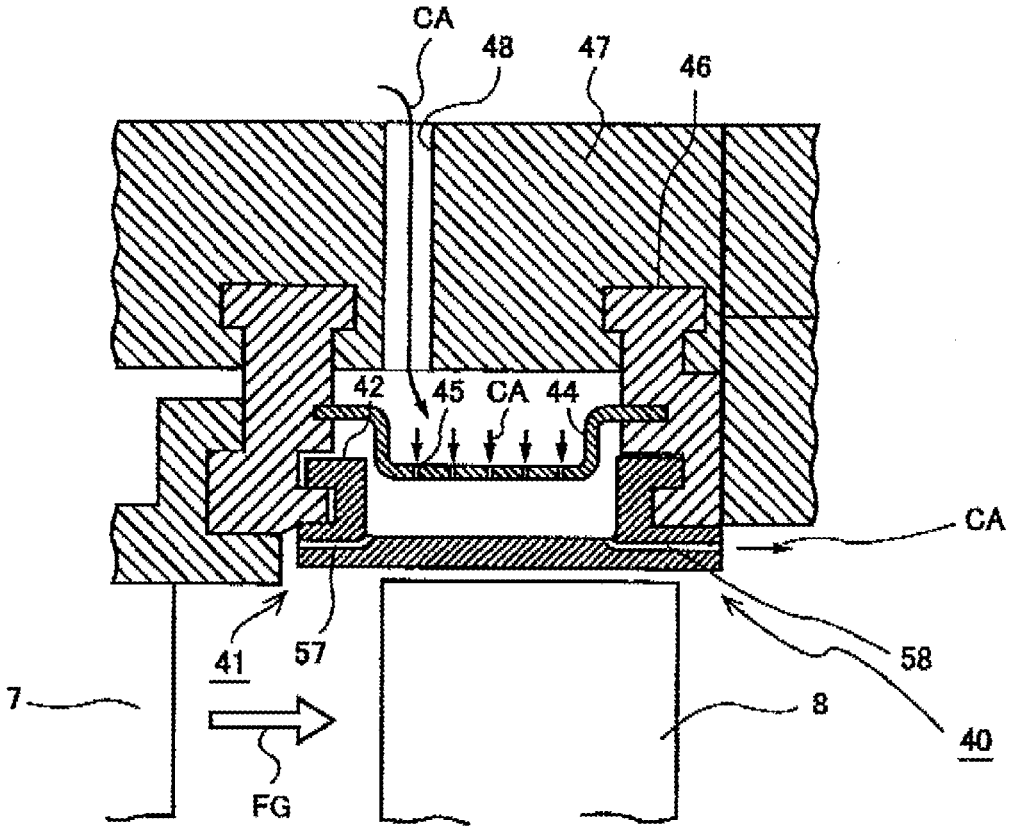
FIG. 8 is a cross-sectional view of essential portions of a conventional ring segment.
Figure 9:
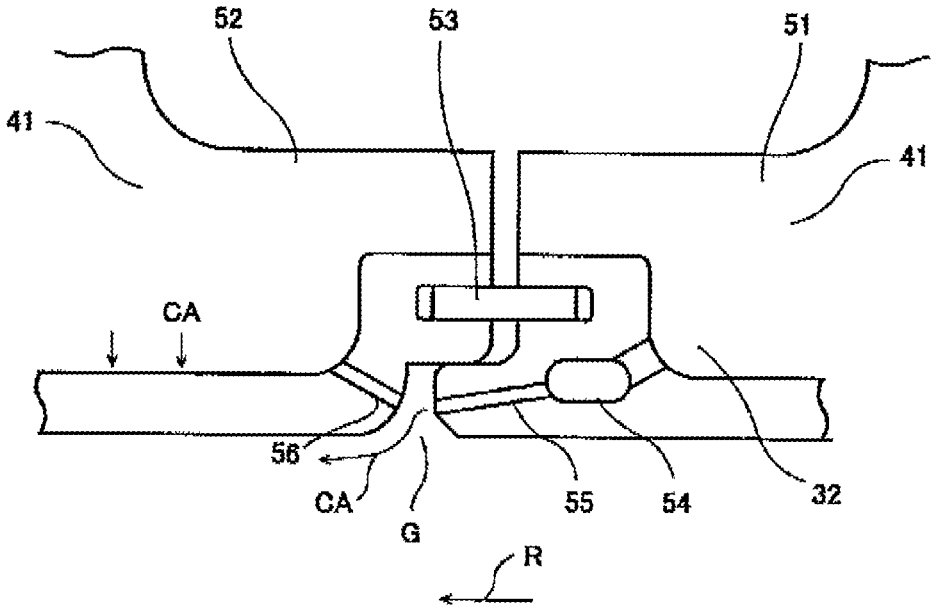
FIG. 9 is an enlarged cross-sectional view of the vicinity of an end portion of a conventional segment body.

Further, in the cooling system of Patent Document 1 shown in FIGS. 8 and 9, there are no cooling passages corresponding to the main-body cooling passages (tint cooling passages) 21 of the present invention which are disposed throughout the length of the end portion 19 of the segment body 11, and only the cooling passages 57 and 58 are partially disposed on the upstream- and downstream-end portions. Moreover, as described above, at the end portion on the rear side in the rotation direction of the segment body 41 shown in Patent Document 1, the cooling passage 56 that directly blows the cooling air after the impingement cooling to the gap between the end portions is provided to carry out the convection cooling on the end portion. However, the cooling air flowing to the cooling passage 56 is directly discharged into the combustion gas. For this reason, an amount of the cooling air increases.

A method of cooling the ring segment and a method of supplying the cooling air in the present embodiment will be described below. The cooling air CA from the casing 47 is supplied to each segment body via the supply hole 48. The cooling air blows from the small holes 45 of the collision plate 44 disposed in the segment body to the cooling space 32, and thus carries out the impingement cooling on the outer circumferential surface of the main body 12 of the segment body. The cooling air CA after the impingement cooling carries out the convection cooling on the upper space of the upstream-end portion 16 when supplied from the upstream end cooling passages (third cooling passages) 26 to the first cavity 20. Further, the cooling air CA supplied to the first cavity 20 flows to the main-body cooling passages (first cooling passages) 21 passing through the main body 12 of the segment body 11 in the axial direction of the rotating shaft 5, and is discharged from the downstream-end face 17*a* into the combustion gas, thereby carrying out the convection cooling on the main body 12. Since the first-region cooling passages 24 are closer to the end portion 19 on the rear side in the rotation direction of the rotating shaft 5 and have a larger passage cross-sectional area compared to the second-region cooling passages 25, they have higher cooling performance than the second-region cooling passages 25. Accordingly, there is a large cooling effect on the vicinity of the corner portion 19*a* of the rear-end portion 19.

Meanwhile, the cooling air CA supplied from the cooling space 32 to the second cavity 22 is supplied to the end portion cooling passages (second cooling passage) 23, and is discharged to the portion of the gap G between the segment bodies 11, thereby carrying out convection cooling on the front-end portion 22, and purging the combustion gas to cool the atmospheric gas. Moreover, the cooling air CA is discharged from the end portion cooling passages (second cooling passage) 23 having a downward slope, blows to the corner portion 19*a* of the end portion 19 on the rear, side of the neighboring segment body 11, and carries out film cooling on the vicinity of the corner portion 19*a* and the inner circumferential surface of the downstream-side segment body 11.

In the cooling system constituting the portion of the gap G between the segment bodies 11, the end portion 18 on the front side in the rotation direction is subjected to the convection, cooling by the cooling air CA from the end portion cooling passages (second cooling passage) 23. Moreover, at the opposite rear-end portion 19 of the neighboring segment body 11, the film cooling effect that is produced on the vicinity of the corner portion 19*a* by the cooling air CA blowing out of the end portion cooling passages (second cooling passage) 23 and the convection cooling effect that is produced by the first-region cooling passages 24 disposed in the end portion 19 an the rear side of the segment body 11 are combined in a superposable manner, and thus the vicinity of the rear-end portion 19 is efficiently cooled. That is, instead of eliminating the cooling passages through which the cooling air CA blows from the rear-end portion 19 toward the gap G as shown in Patent Document 1, the first-region cooling passages 24 are disposed adjacent to the end portion 19, so that the convection cooling of the end portion 19 is strengthened, and the cooling performance can be maintained to the same extent as the conventional cooling method shown in Patent Document 1.

That is by the combination of the end portion cooling passages (second cooling passages) 23 of the portion of the gap G between the segment bodies 11 and the first-region cooling passages 24 of the neighboring segment body 11, the cooling performance of the end portions 18 and 19 on the opposite sides of the portion of the gap G is improved, and the amount of the cooling air is reduced.

Furthermore, in the case the segment body 11 is provided with cooling passages in which the main-body cooling passages (first cooling passages) 21 and the upstream end cooling passages (third cooling passages) 26 are combined to have the structure of turning back in the axial direction of the rotating shaft 5, the cooling performance of the segment body 11 is further improved. That is, the combustion gas FG flowing to the vicinity of the segment body 11 has the highest pressure around the upstream-end portion located upstream of the flow direction thereof and the lowest pressure around the downstream-end portion located downstream of the flow direction thereof. Accordingly, the cooling air CA, which flows from the cooling space 32 to the upstream end cooling passages (third cooling passages) 26 in the axial direction of the rotating shaft 5 and then is supplied to the first cavity 20, and flows to the main-body cooling passages (first cooling passages) 21 in the axial direction of the rotating shaft 5 and then is discharged from the downstream-end face 17*a*, makes maximum use of a differential pressure between the cooling air CA supplied from the casing 47 and the cooling air discharged from the downstream-end face 17*a*.

That is, since the main-body cooling passages (first cooling passages) 21 arranged in the axial direction of the rotating shaft 5 can form the cooling passages so as to use a maximum differential pressure and to have a maximum length in the axial direction of the rotating shaft 5, they provide high cooling performance and can reduce the amount of cooling air compared to the related art. In other words, in comparison with the cooling passages 57 and 58 that are axially arranged in the main body of the segment body 11 shown in FIG. 8, the amount of cooling air flowing through the main-body cooling passages (first cooling passages) 21 is reduced as the length of the axial passage is increased to use the maximum differential pressure. In short, since the cooling air CA flowing through the main-body cooling passages (first cooling passages) 21 carries out the impingement cooling on the main body 12 of the segment body 11, and then performs the convection cooling on the upstream-end portion 16 and the main body 12 as well as the vicinity of the rear-end portion 19, the cooling air is reused to the maximum extent, and thus efficiently cools the main body of the segment body 11.

Meanwhile, in the case of the cooling passages shown in Patent Document 1, since the cooling passage 57 of the upstream-side end portion is open on the upstream-end face where the pressure of the combustion gas is highest, and discharges the cooling air CA into the combustion gas FG without being able to sufficiently use the differential pressure between the cooling air CA, supplied from the casing and the cooling air discharge from the upstream-end face, the amount of cooling air is increased, and the cooling performance is reduced, compared to the present invention.

The first-region cooling passages 24 constitute some of the main-body cooling passages (first cooling passages) 21, and use the reused cooling air CA to strengthen the cooling performance by means of the enlargement of the passage cross-sectional area and to compensate for the cooling performance of the rear-end portion 19 by using the cooling air in the proximity of the end portion 19, and thereby the cooling of the end portion 19 is strengthened. That is, by not using the air blowing into the portion of the gap G between the rear-end portions 18 and 19 and by using the air reused for the cooling air CA flowing through the first-region cooling passages 24, it is possible to have the same cooling performance as the related art and reduce the amount of cooling air for the segment body.

Further, since the cooling air, which directly blows from the cooling passage 56 on the rear side in the rotation direction shown in Patent Document 1 into the gap between the end portions 18 and 19, blows in the direction opposite to the rotation direction of the turbine blades 8, this is responsible for the loss on the turbine blades 8. However, the present invention has an advantage in that, since the cooling passage 56 is not used, the loss of the turbine blades 8 does not take place, and the thermal efficiency of the turbine is improved.

According to the configuration of the present embodiment, the atmospheric gas in the portion of the gap G between the end portions 18 and 19 is purged, and thus the temperature thereof is reduced. Moreover, as described above, the cooling performance of the portion of the gap G between the end portions 18 and 19 of the segment bodies 11 is strengthened, and thus the amount of cooling gas is reduced. As a result, the oxidation and thinning of the vicinity of the end portions 18 and 19 of the segment bodies 11 are prevented. In addition, the amount of cooling air for the entire segment body 11 is reduced, and the thermal efficiency of the turbine is improved.

Second Embodiment

Figure 4:
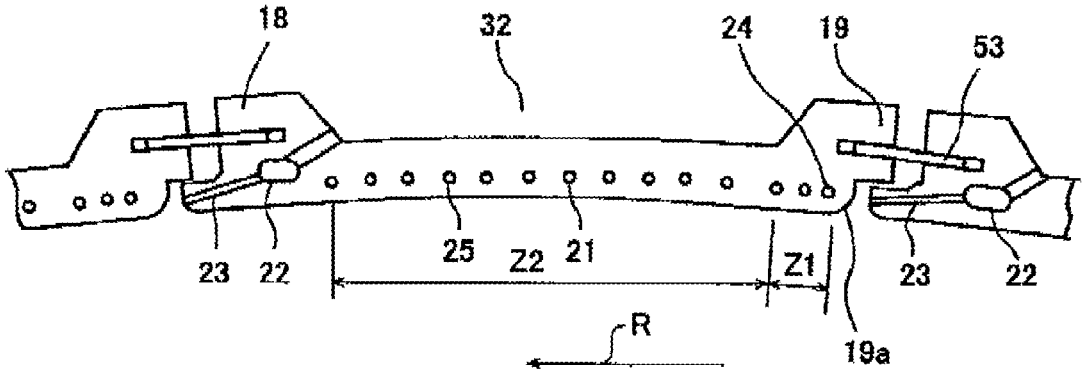
FIG. 4 is a cross-sectional view of a segment body according to a second embodiment

The second embodiment will be described below with reference to FIGS. 4 and 5. As shown in FIG. 4, the present embodiment has the same configuration as the first embodiment except that the configuration of the first-region cooling passages 24 is different. That is, the second embodiment is different from the first embodiment in that, in comparison with the second-region cooling passages 25, the first-region cooling passages 24 are formed in a circular shape and arranged with the same hole diameter, but have a smaller arrangement pitch than the second-region cooling passages 25, thereby improving the cooling performance.

It is preferable that a plurality of the first-region cooling passages 24 be provided. Moreover, the cooling passages may have an elliptical shape, a rectangular shape, or a slit shape, rather than the circular shape. The passages other than the first-region cooling passages 24 have the same opening cross-sectional area.

In the present embodiment, the cooling system shown in FIG. 5 can be applied except for the configuration of the first-region cooling passages 24 of the segment body 11.

Moreover, the present embodiment is the same as the first embodiment in that the first-region cooling passages 24 are designed to have higher cooling performance than the second-region cooling passages 25, and the operation and effects caused by the configuration of the present embodiment are the same as the first embodiment.

The present invention is not limited to the embodiments described above but embraces modifications and improvements within the scope capable of accomplishing the object of the present invention.

INDUSTRIAL APPLICABILITY

According to the cooling system of a ring segment and the gas turbine of the present invention, it is possible to prevent the oxidation and thinning of the end portion of the main body of the segment body, and to reduce the amount of cooling air for the end portion. Thereby, the amount of cooling air for the entire ring segment is reduced, and thermal efficiency of the entire gas turbine is improved.

DESCRIPTION OF REFERENCE NUMERALS

1: gas turbine
2: compressor
3: combustor
4: turbine
5: rotating shaft
6: generator
7: turbine vane
8: turbine blade
10, 40: ring segment
11, 41: segment body
12: main body
16: upstream-end portion
17: downstream-end portion
17*a*: downstream-end face
18, 19, 51, 52: end portion
20: first cavity
21: main-body cooling passage (first cooling passage)
22: second cavity
23: end portion cooling passage (second cooling passage)
24: first-region cooling passage
25: second-region cooling passage
26: upstream end cooling passage (third cooling passage)
27: junction passage
31: reception space
32: cooling space
42: hook
44: collision plate
45: small hole
46: isolation ring
47: casing
48: supply hole
53: seal plate
54: cavity
55, 56, 57, 58: waling passage

The invention claimed is:

1. A cooling system of a ring segment for a gas turbine, which is formed from a plurality of segment bodies disposed around a rotating shaft in an annular shape, and a seal plate for sealing a gap between end portions facing each other in a direction of the rotating shaft of the segment bodies adjacent to each other, wherein the segment body includes:

first cooling passages formed from cooling passages of a first region and cooling passages of a second region, the first-region cooling passages being disposed in an axial direction of the rotating shaft of a main body of the segment body and disposed adjacent to the end portion on a rear side in a rotation direction, and the second-region cooling passages being disposed on a farther front side in the rotation direction than the first-region cooling passages and having a smaller passage cross-sectional area than the first-region cooling passages;

second cooling passages disposed at one of the end portions in a direction approximately perpendicular to the first cooling passages, and blowing a cooling air toward the end portion of the neighboring segment body; and third cooling passages formed on a farther outer side in a radial direction than the first cooling passages of an upstream-end portion of the segment body, and connecting a first cavity, which is disposed approximately perpendicular to the axial direction of the rotating shaft at the upstream-end portion, with a cooling space, which is surrounded by the main body of the segment body and a collision plate having a plurality of small holes, wherein the first-region cooling passages are disposed adjacent to the second cooling passages of the neighboring segment body.

2. A cooling system of a ring segment for a gas turbine, which is formed from a plurality of segment bodies disposed around a rotating shaft in an annular shape, and a seal plate for sealing a gap between end portions facing each other in a direction of the rotating shaft of the segment bodies adjacent to each other, wherein the segment body includes:

first cooling passages formed from cooling passages of a first region and cooling passages of a second region, the first-region cooling passages being disposed in an axial direction of the rotating shaft of a main body of the segment body and disposed adjacent to the end portion on a rear side in a rotation direction, and the second-region cooling passages being disposed on a farther front side in the rotation direction than the first-region cooling passages and having a greater arrangement pitch than, the first-region cooling passages;

second cooling passages disposed at one of the end portions in a direction approximately perpendicular to the first cooling passages, and blowing a cooling air toward the end portion of the neighboring segment body; and third cooling passages formed on a farther outer side in a radial direction than the first cooling passages of an upstream-end portion of the segment body, and connecting a first cavity, which is disposed approximately perpendicular to the axial direction of the rotating shaft at the upstream-end portion, with a cooling space, which is surrounded by the main body of the segment body and a collision plate having a plurality of small holes, wherein the first-region cooling passages are disposed adjacent to the second cooling passages of the neighboring segment body.

3. The cooling system of a ring segment according to claim 1 or 2, wherein the second cooling passages are disposed at least at the end portion on the front side in the axial direction of the rotating shaft.

4. The cooling system of a ring segment according to claim 1 or 2, wherein the second cooling passages have a slope for blowing toward a corner portion of a lower side of the end portion of the neighboring segment body.

5. The cooling system of a ring segment according to claim 1 or 2, wherein the first and third cooling passages have a structure of turning back in the axial direction of the rotating shaft via the first cavity, and the first cooling passages are disposed to pass from the first cavity through the main body of the segment body in the axial direction of the rotating shaft and to open on a downstream-end face.

6. A gas turbine having the cooling system of a ring segment according to claim 1 or 2.

7. The cooling system of a ring segment according to claim 3, wherein the second cooling passages have a slope for blowing toward a corner portion of a lower side of the end portion of the neighboring segment body.

8. The cooling system of a ring segment according to claim 3, wherein the first and third cooling passages have a structure of turning back in the axial direction of the rotating shaft via the first cavity, and the first cooling passages are disposed to pass from the first cavity through the main body of the segment body in the axial direction of the rotating shaft and to open on a downstream-end face.

9. The cooling system of a ring segment according to claim 4, wherein the first and third cooling passages have a structure of turning back in the axial direction of the rotating shaft via the first cavity, and the first cooling passages are disposed to pass from the first cavity through the main body of the segment body in the axial direction of the rotating shaft and to open on a downstream-end face.

10. A gas turbine having the cooling system of a ring segment according to claim 3.

11. A gas turbine having the cooling system of a ring segment according to claim 4.

12. A gas turbine having the cooling system of a ring segment according to claim 5.

* * * * *